United States Patent [19]

Luther

[11] 4,178,501

[45] Dec. 11, 1979

[54] ELECTRONIC VOTING MACHINE

[75] Inventor: Henry D. Luther, Massillon, Ohio

[73] Assignee: R. F. Shouptronics Corp., Bryn Mawr, Pa.

[21] Appl. No.: 724,120

[22] Filed: Sep. 17, 1976

[51] Int. Cl.[2] ..... G07C 13/00

[52] U.S. Cl. ..... 235/54 F

[58] Field of Search ..... 235/54 F

[56] References Cited

U.S. PATENT DOCUMENTS

| | | | |
|---|---|---|---|
| 3,779,453 | 12/1973 | Kirby et al. | 235/54 F |
| 3,793,505 | 2/1974 | McKay et al. | 235/54 F |
| 4,010,353 | 3/1977 | Moldovan, Jr. et al. | 235/54 F |
| 4,025,757 | 5/1977 | McKay et al. | 235/54 F |

*Primary Examiner*—Stephen J. Tomsky

*Attorney, Agent, or Firm*—Woodcock, Washburn, Kurtz & Mackiewicz

[57] ABSTRACT

An electronic memory stores votes cast for candidates by means of voting switches which are actuated by the voter. Shields mounted on hinges can be positioned over the switches. The shields have cut-out portions thereon which expose the switches. The voter can select from one group of candidates when a shield is positioned over the switches and from another group of candidates when the shield is not positioned over the switches. Switch means operated by movement of a shield on its hinge connects the switches to one portion of the memory when the shield is positioned over the switch and to a different portion of the memory when it is not so that the same switches can be used to vote for two or more different groups of candidates. A personal choice keyboard is provided. The keys actuate switches which are connected to the electronic memory for storing therein alphabetic representations of personal choice candidates selected by each voter.

2 Claims, 15 Drawing Figures

11
69
TRANSMIT
RECEIVE
BUFFER 1
2
16
1
2
16
73
68
SCAN
TRANSMIT
SCAN
RECEIVE
10
INTERRUPT
SHIELD POSITION
74
FF
FF
FF
FF
V
52A
53A
75
15A
65A
66A
67A
80A
KEYS
81A
27A
RECORD
VOTE
25
CHAR.
GEN.
82
CHAR.
GEN.
83
DISPLAY
26

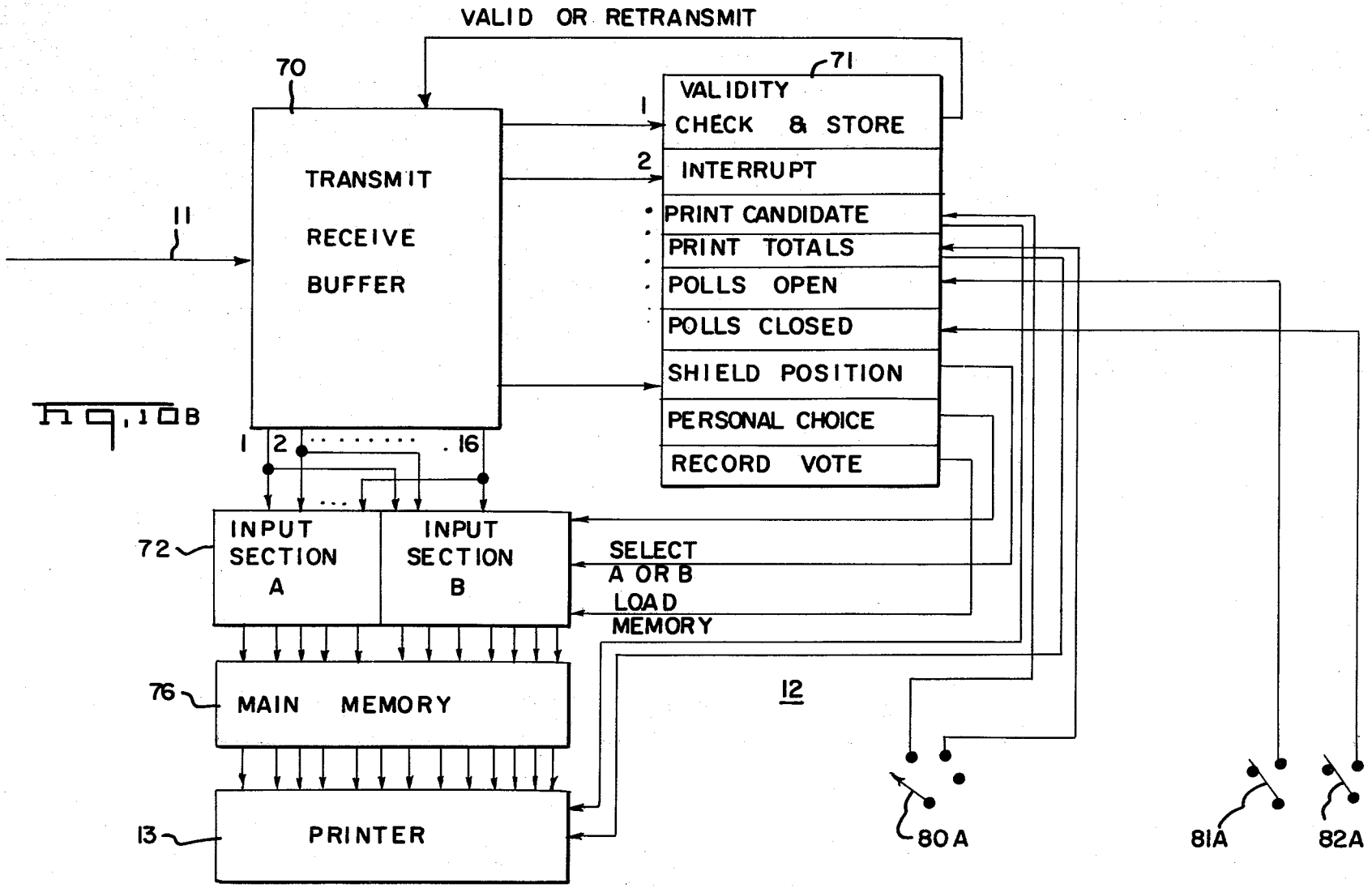
VALID OR RETRANSMIT
VALIDITY CHECK & STORE
INTERRUPT
PRINT CANDIDATE
PRINT TOTALS
POLLS OPEN
POLLS CLOSED
SHIELD POSITION
PERSONAL CHOICE
RECORD VOTE
71
1
2
TRANSMIT
RECEIVE
BUFFER
70
11
16
2
1
INPUT SECTION B
INPUT SECTION A
72
SELECT A OR B
LOAD MEMORY
12
MAIN MEMORY
76
PRINTER
13
82A
81A
80A
B

ELECTRONIC VOTING MACHINE

BACKGROUND OF THE INVENTION

This invention relates to voting machines and more particularly to an electronic voting machine.

Mechanical voting machines have been available and in extensive use for some time. Examples of such machines are shown in U.S. Pat. Nos. 2,054,102 and 3,054,557 to R. F. Shoup. These machines have been successfully used to record and totalize all of the votes made by voters on that machine. Such machines are capable of preventing the casting of illegal votes.

The disadvantages of such a machine include being large and cumbersome. Also, they contain many movable parts and much servicing is required. A machine should be capable of being set up for an election in less time than that required for the present mechanical voting machines.

Another problem which has beset users of mechanical voting machines is the proliferation of candidates in recent years. Sometimes there may be as many as thirty or more candidates for an office. It is quite difficult to set up mechanical voting machines to accommodate all of these candidates.

Providing for a voter's personal choice candidates has always been a problem. Traditionally, voters have been able to "write-in" the candidate of their choice even though that candidate's name does not appear on the ballot. An error free system for recording and tabulating such votes is needed.

Security from voter fraud has been one of the principal advantages of mechanical voting machines. The recent use of computerized data processing techniques has not always been accompanied by the security which is required in the voting process.

SUMMARY OF THE INVENTION

Accordingly, it is an important object of the present invention to provide an electronic voting system which is reliable, relatively light-weight and small in size, economical in initial cost and servicing, and secure.

In accordance with one object of the present invention, efficient use is made of voting switches by using the same switches for voting for more than one group of candidates. One or more shields are mounted on a hinge so that a shield can be positioned over the voting switches. The shield has cut-out portions therein which expose the switches when the shield is positioned over them. The voter can select from one group of candidates when the shield is not over the voting switches. When the shield is over the voting switches the voter can select from another group of candiates. Switch means are operated by movement of the shield on its hinge. These switch means connect the voting switches to one portion of an electronic memory when the shield is positioned over the switches and to a different portion of the memory when it is not. The same voting switches and the same printed circuitry associated with these switches are used for voting for two or more groups of candidates. This reduces the cost of the machine considerably, and it also contributes significantly to compactness and light weight of the machine.

In accordance with another object of this invention personal choice votes are recorded by means of a keyboard which is operated by the voter to spell out the name of the candidates of his choice. A display displays the personal choice selection which has been typed out by the voter and this selection is electronically recorded in computer memory.

It is another object of the present invention to provide an arrangement of switches and an interface which communicates with the electronic memory of a small digital computer in an efficient and reliable manner. The switches are continuously scanned by a scanner which generates a digital signal representing the address of a switch which has been actuated. These digital signals are supplied to the digital computer. The digital signals represent a voter's selection of a candidate, alphabetic characters typed out on the personal choice keyboard, shield position, the recording of votes, and other voting functions dependent upon which switches have been operated in the voting procedure.

Each voting switch has a light indicator associated with it. When the voter makes a valid voting selection, the digital computer transmits to the voting terminal a digital signal representing the address of the switch which made that valid selection. This digital signal is decoded and energizes the light associated with that voting switch. In this manner, the voter knows immediately that he has made a valid voting selection. By looking at the indicating light, the voter knows the selections he has made. When he is satisfied with his voting selection, he depresses a record vote switch which causes the computer to record the voting selections in memory.

It is a further object of the present invention to provide a secure locking arrangement for the vote totalizing memory so that access thereto can be obtained by authorized personnel with minimum possibility of fraudulent altering of the vote totals. A printer prints out the list of candidates and voting totals. The printer is enabled only when locks are in the correct positions. These locks are interconnected so that they can be operated only once to open the polls and only once to close the polls.

The foregoing and other objects, features and advantages of the invention will be better understood from the following more detailed description and appended claims.

DESCRIPTION OF THE DRAWINGS

FIG. 5 is a section on the line 5—5 of FIG. 4 and shows the switching means;

FIGS. 10A and 10B are electrical block diagrams of a voting terminal and the central processor;

FIG. 13 is the same view of the locking mechansims as shown in FIG. 11 but without the switches, springs and links of FIG. 11 so that the link connecting two locks can be viewed; and FIG. 14 shows the same components as FIG. 13 as viewed from below.

DESCRIPTION OF THE PREFERRED EMBODIMENT

Figure 1:
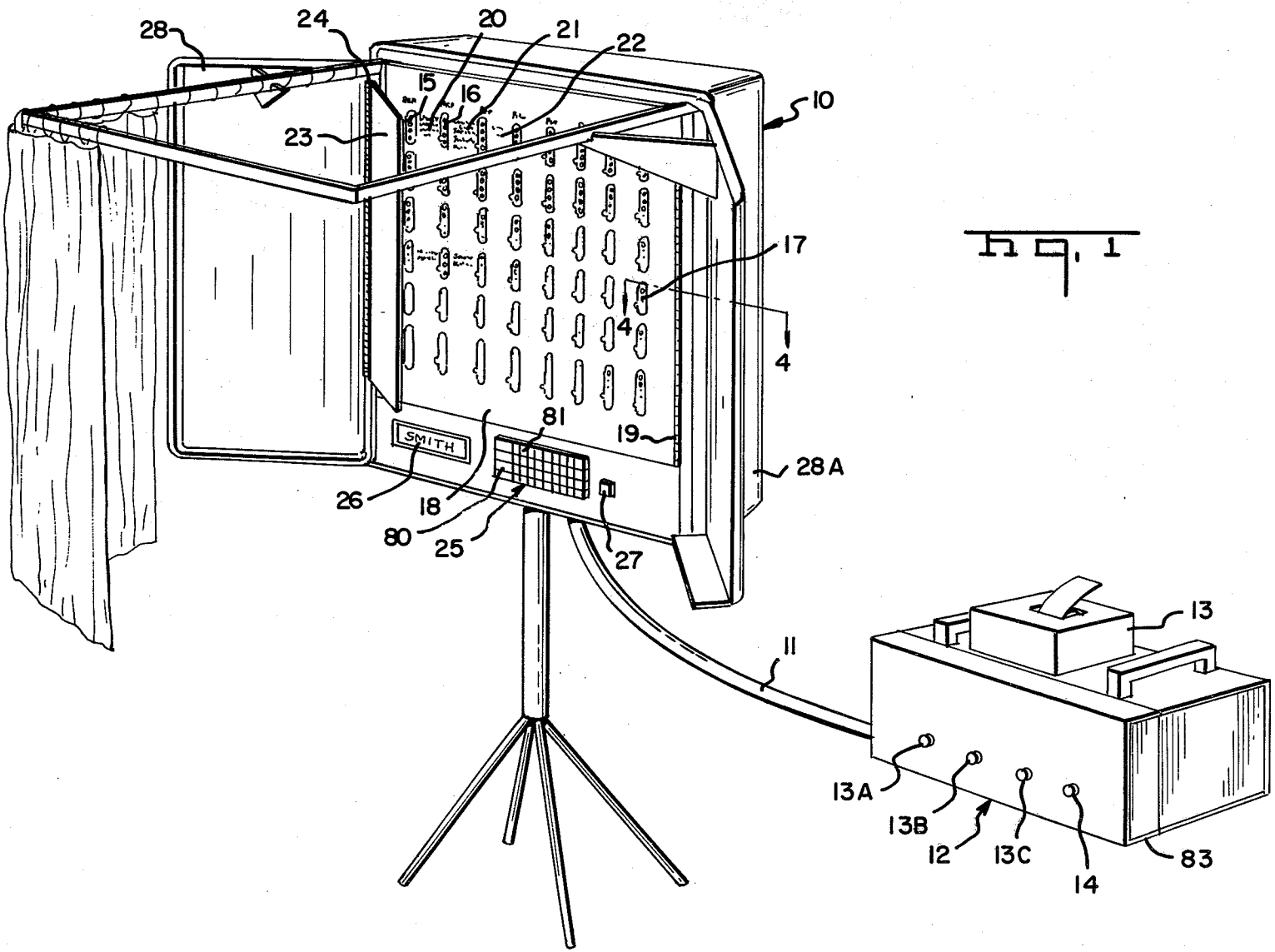
FIG. 1 shows the voting terminal and the digital computer.

FIG. 1 shows a voting terminal 10 connected by a cable 11 to the central processor which includes a small digital computer 12, commonly referred to as a minicomputer. This unit can be one of a number of commercially available minicomputers, one example of which is the model LS12/10 sold by the Computer Automation Company. A printer 13 prints totals of the votes cast. In one embodiment of the invention up to sixteen voting terminals 10 can be connected to each minicomputer 12. The case of the computer has locking mechanisms 13A, 13B, 13C and 14 which will subsequently be described in detail.

The voting terminal includes columns of voting switches 15, 16, 17 and others for casting ballots. When a voter actuates one of these switches by depressing it, a vote for a particular candidate is stored in the electronic memory which is included in the minicomputer 12.

A shield 18 has a hinge 19. The shield 18 can be positioned over the voting switches as shown in FIG. 1 or it can be moved on its hinges to expose the switches and the front panel on which they are mounted. The shield 18 has cut-out portions which also expose the same switches when the shield is in the position shown in FIG. 1. Therefore, these switches can be used for voting for two or more different groups of candidates, one of which is identified by the legends in the columns 20, 21, 22 and others. Another set of candidates is identified by legends on the front panel on which the switches are mounted.

While a single shield has been shown in FIG. 1, two or more shields can be provided. Alternatively, the shield can be split into two portions or only half a shield can be provided.

An office identifying panel 23 is hinged at 24. The panel 23 carries the names of the offices for which the candidates are running. The panel 23 may identify the offices for both groups of candidates, or a different office panel may identify a group of candidates for different offices.

In order to make a personal choice vote, a keyboard 25 is provided. This keyboard has a plurality of keys such as 80 and 81 with alphabetic indicia thereon. The keys actuate switches which are connected to the memory in the computer 12 in the same manner that the voting switches are connected. When the keys on the keyboard 25 are actuated, they store in memory an alphabetic representation of the personal choice candidate selected by each voter. As keys are depressed, a display of the alphabetic characters appears on the display 26. This display includes a number of light emitting diodes.

The keyboard 25 and display 26 are mounted under the columns of voting switches. A record-vote switch 27 is mounted next to the keyboard 25. When the voter has made all of his voting choices, he presses the switch 27 to record his vote.

Doors 28 and 28A are provided to completely enclose the terminal unit when it is being transported to the polling place. When the doors are open, a frame extends from the unit to mount a secrecy curtain.

The Shield For Access To Different Groups of Candidates, FIGS. 2–9

Figure 2:
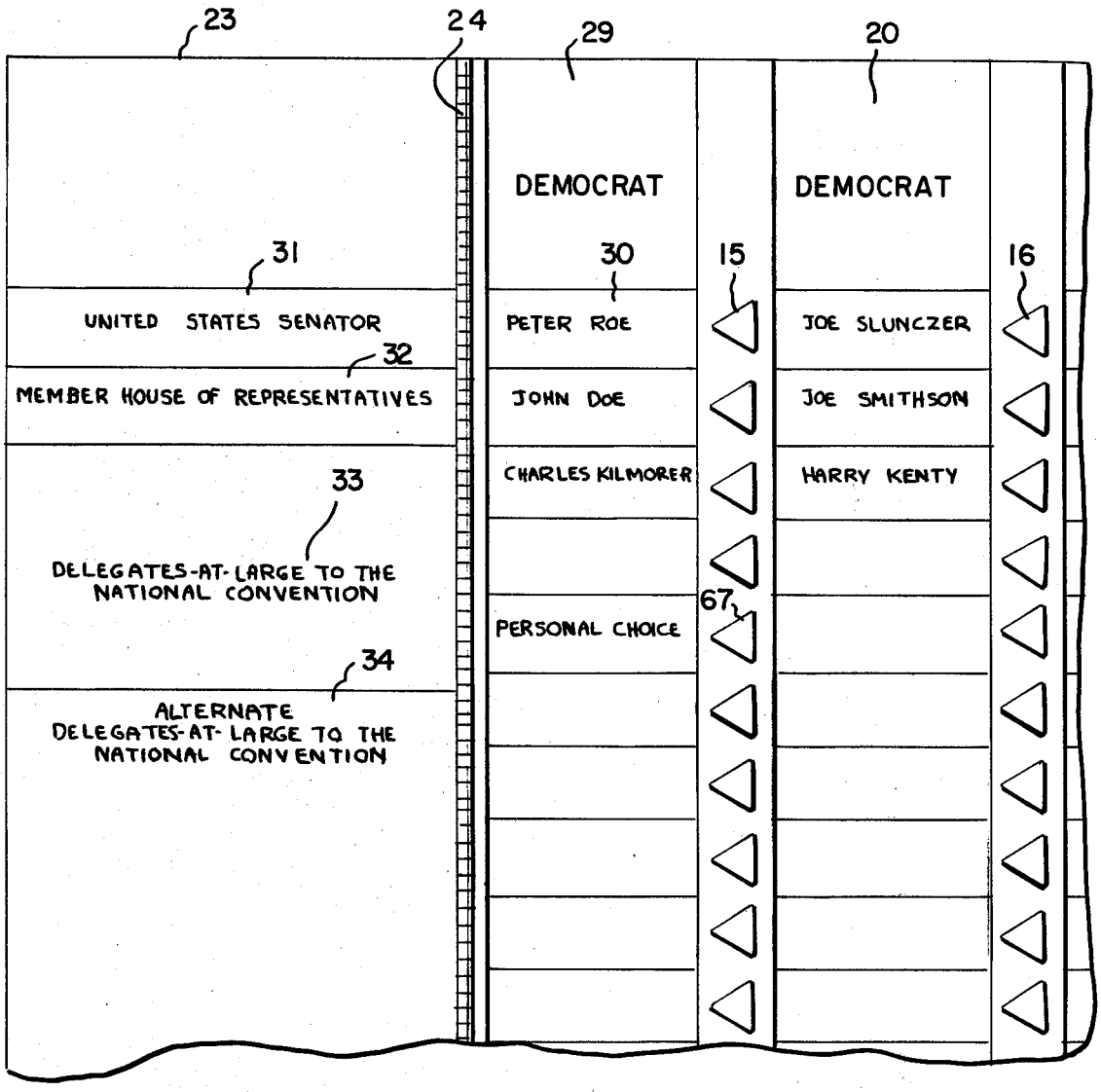
FIG. 2 shows a portion of the voting machine with voting switches, candidate identifications and the office identification panel.

FIG. 2 shows the upper left hand corner of the front panel 29. The voting switches 15, 16 and others protrude through the front panel. Next to each switch is an identification, such as 30, of the candidate with which that switch is associated. The office identifying panel 23 has identifications 31–34 indicating the office for which the candidates are running.

Figure 3:
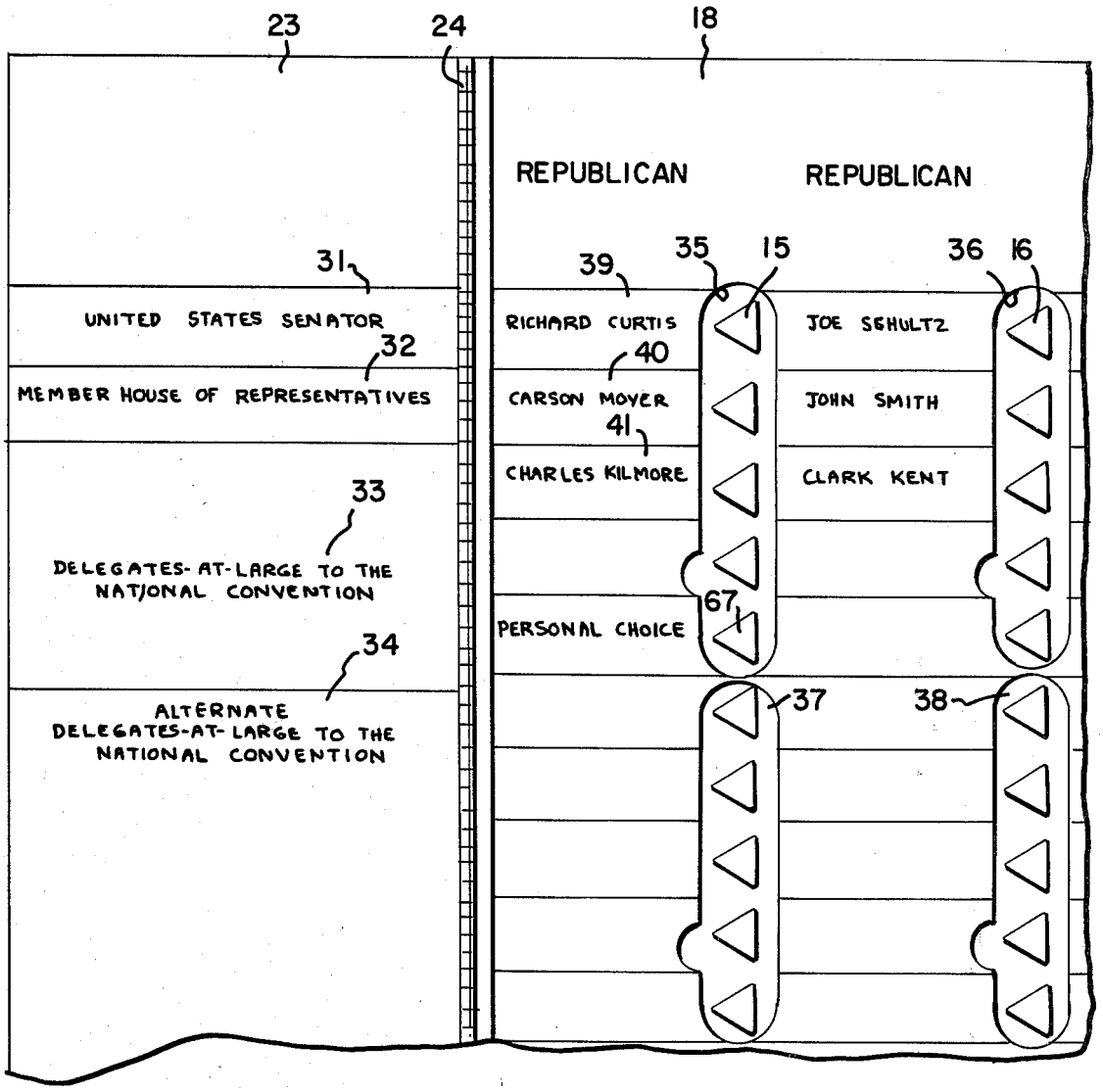
FIG. 3 is the same view as FIG. 2 but with a shield in place over the voting switches.

FIG. 3 shows the same voting switches with the shield 18 in place over them. The shield 18 has cut-out portions 35–38 and others. These cut-out portions expose the voting switches such as 15 and 16 so that these switches can be used to vote for another group of candidates. In this case, the candidates are indicated at 39, 40, 41 on the shield 18.

Figure 4:
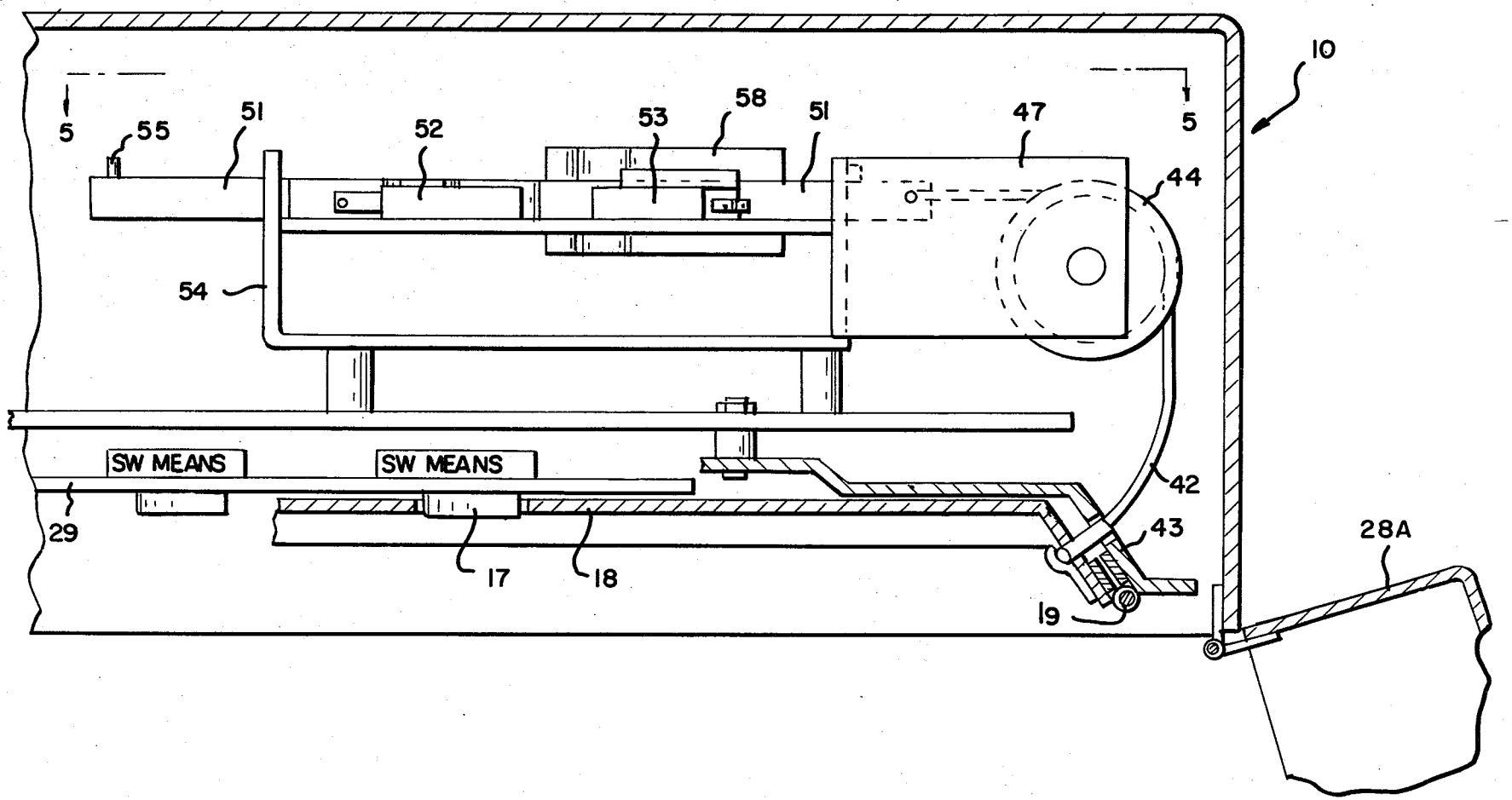
FIG. 4 is a section along line 4—4 of FIG. 1 and shows how the shield is connected to the switching means.

The votes for these two groups of candidates must be accumulated in different portions of the memory. In order to do this, the shield 18 operates switch means when the shield is moved on its hinge. The connection of the shield to the switch means is shown in FIG. 4 and the switch means are more fully shown in FIGS. 5–9. FIG. 4 is a section on the line 4—4 of FIG. 1. FIG. 4 shows the shield 18 positioned over the voting switches with the switches such as 17 protruding through the cut-out portion in the shield.

A cable 42 is fixed to the shield 18 at one end thereof. The cable extends through an opening in the main frame 43 and over a pulley 44. Its other end is connected to the actuating rod 51.

As the shield 18 is opened and closed, movement of cable 42 over pulley 44 will cause actuating rod 51 to reciprocate.

Referring to FIGS. 5–8, a spring 48 is provided to return the rod 51 to its rest position. An arm 49 is fixed to the end of shaft 46 and is biased by the spring. The actuating rod 51 makes and breaks contact in first and second microswitches 52 and 53. Microswitch 53 senses the position of the shield. It is operated to a first, closed, position, shown in FIGS. 4 and 8, when the shield 18 is positioned over the voting switches. The switch 53 is in a second position when the shield 18 is not over the voting switches.

The first microswitch 52 generates an INTERRUPT signal each time the shield 18 is opened or closed.

The actuating rod 51 for these switches is fixed for reciprocating motion in the frame 47 on one end and a frame extension 54 on the other end. Its travel is limited in both directions by roll pins 55 and 56 which will stop against the walls of the frame extension 54 and frame 47.

Figure 9:
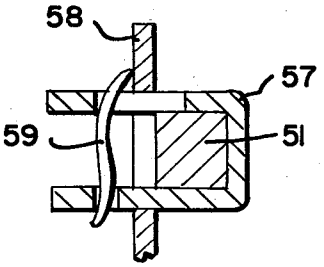
FIG. 9 is a section on the line 9—9 of FIG. 5.

As the shaft 46 is rotated, the actuating rod 51 is moved toward the right. Since it is necessary for the second switch 53 to be actuated first upon movement of actuating rod 51 in either direction of travel, a lost motion actuator is provided. This includes a "U-shaped" member 57 which straddles actuating rod 51 as best shown in FIG. 9. The lost motion actuator also includes a retainer plate 58 and a torsion spring 59. Spring 59 maintains sufficient force on retaining plate 58 to make a frictional fit with rod 51 so actuator 57 will move with the rod 51 unless it is otherwise stopped. Since only a small amount of travel is desired for this actuator, stop means in the form of a shoulder 60 and a bent over ear 61 are provided on retainer plate 58 to limit its travel. Shoulder 60 engages the left side of wall 62 of frame 47 to limit rightward travel. Ear 61 engages the right side of wall 62 to limit leftward travel.

Figure 6:
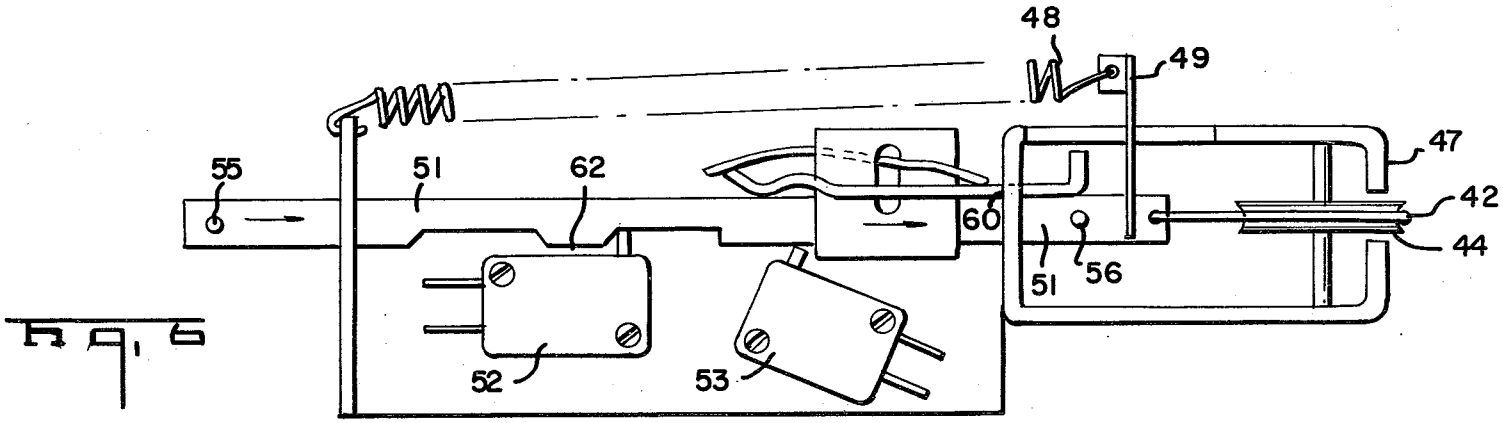
Figure 7:
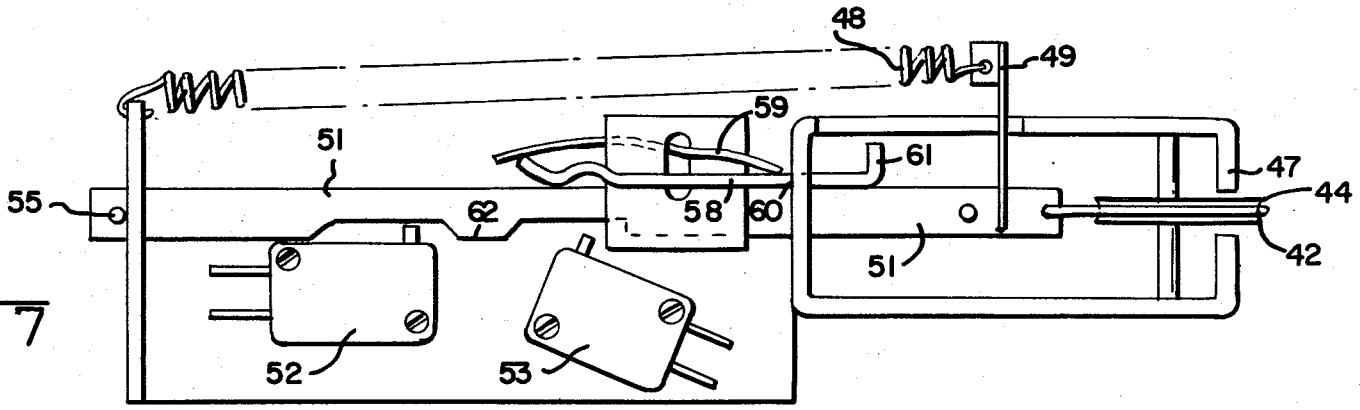

As viewed in FIG. 6, initial movement of rod 51 to the right, caused by opening shield 18, immediately releases the actuator on the second, position sensing, switch 53. Thereafter, the camming surface 62 on actuator rod 51 operates the first switch 52. This generates an INTERRUPT signal which enables the computer to accept a new signal generated by the second switch 53 indicating the position of the shield.

Figure 7:
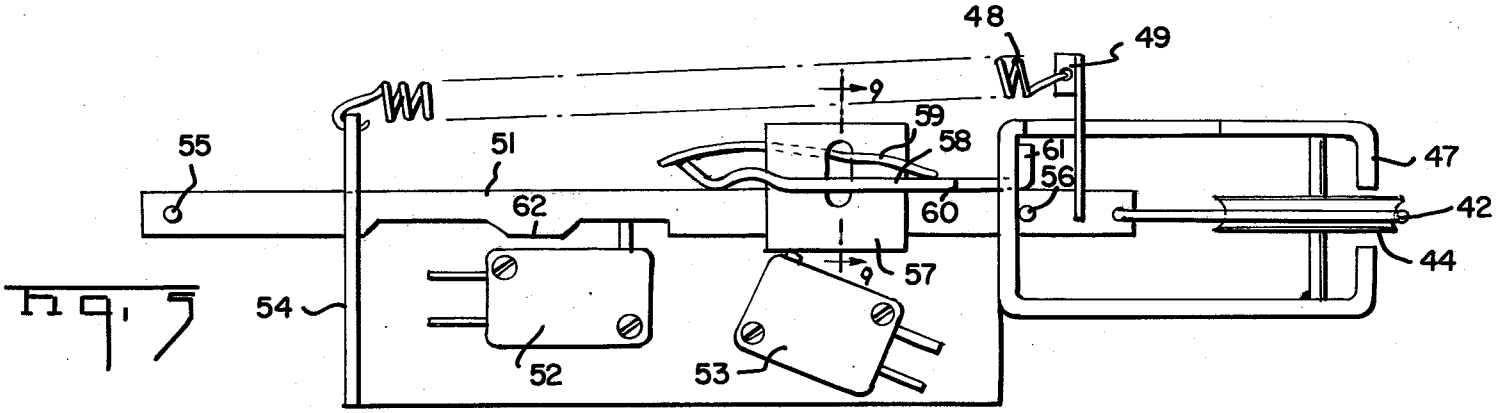
FIGS. 6–8 are views similar to FIG. 5 but showing the shield operated switching means in different positions.

The lost motion actuator 57 moves with the actuator rod 51 toward the right until the actuator 57 is stopped by shoulder 60 bearing against wall 62. The actuator rod 51 continues its rightward movement until the camming surface 62 has passed completely over the actuator of the switch 52. This is shown in FIG. 7 where the shield is completely open.

Figure 8:
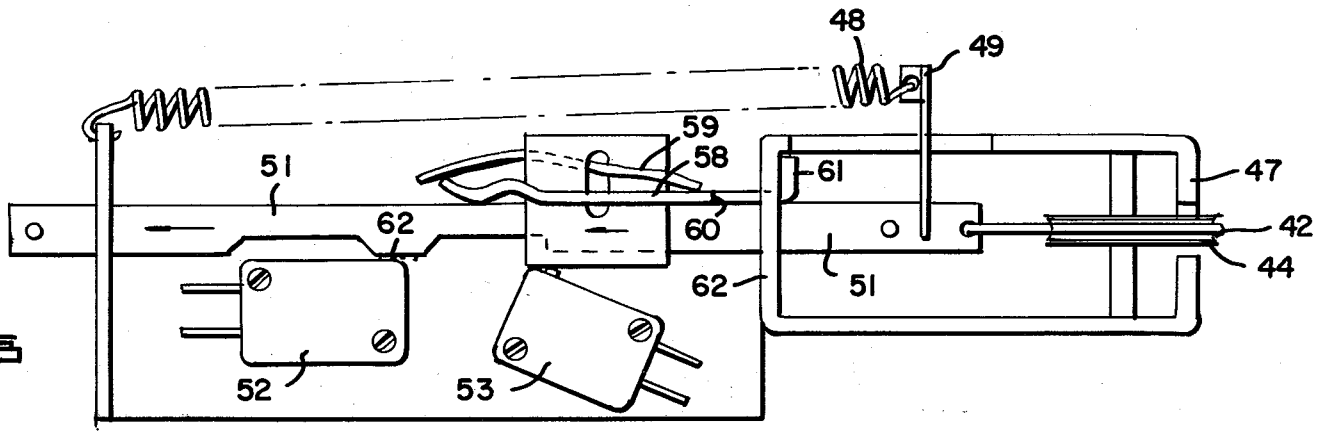

When the shield 18 is closed, actuating rod 51 moves toward the left. Lost motion actuator 57 is initially carried with rod 51 because of the friction fit therebetween. Lost motion actuator 57 immediately operates switch 53. Further motion to the left causes caming surface 62 to operate switch 52 as shown in FIG. 8. This generates an INTERRUPT signal which again enables the computer to accept a new encoded signal representing the new position of the shield.

Figure 10A:
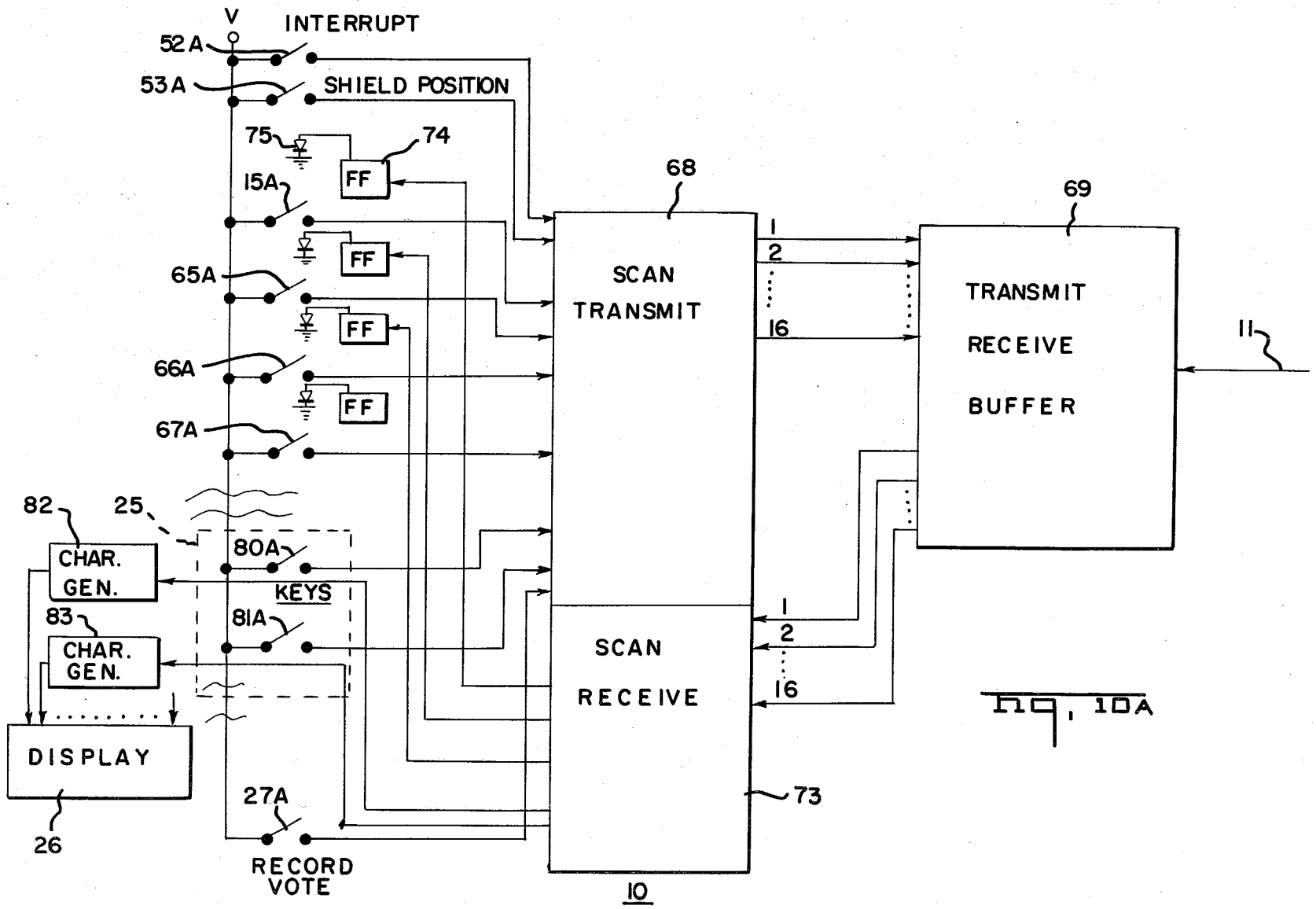

The Electrical Block Diagram, FIGS. 10A and 10B

FIG. 10A shows an electrical block diagram of the voting terminal. Four voting switches out of a total of 256 voting switches have been shown in FIG. 10A. The contacts of the voting switches which have been shown are designated by the numerals 15A, 65A, 66A and 67A. (All switch contacts on FIGS. 10A and 10B have the same reference numerals as the switches shown in other figures, but with A added to designate the contact). These are spring return switches which are momentarily depressed by the voter when he wants to select a candidate. A scanning circuit 68 scans the switches at a high scanning rate. When any of the switches are closed, scanning circuit 68 generates a 16 bit binary signal which designates the address of the closed switch. This parallel 16 bit signal is applied to a transmit-receive buffer 69 which applies the signal serial-by-bit to the two wire line included in the cable 11. The transmit-receive buffer 69 adds parity bits to the signal.

The signal is applied to a transmit-receive buffer 70 in the minicomputer 12 shown in FIG. 10B. The transmit-receive buffer 70 checks parity of the signal. The operations sections 71 of the minicomputer 12 is programmed to check the validity of the voter's selection as represented by the signal currently stored in tramsit-receive buffer 70. For example, the operations section 71 checks whether the voter has previously made a selection for that office. The voter's previous selections are stored in the input section 72 of the computer's main memory. By merely determining whether the addresses of signals stored in that memory correspond with the addresses of switches associated with other candidates for that office, the operations section 71 determines whether the signal stored in transmit-receive buffer 70 is a valid voting selection. It will be appreciated that numerous other validity checks can be performed on each voter's selection. The standard, commercially available, minicomputer is a versatile machine which is capable of performing numerous validity checks such as this. The computer routinely checks the validity of voting selections and stores these selections in the input section of memory. It also performs other functions in response to INTERRUPT signals which are generated by the voting system as will be subsequently described.

It is an important feature of this invention that the results of the validity checks which the computer performs are immediately made known to the voter in the following manner.

If the operations section 71 determines that the voter selection represented by the signal stored in transmit-receive buffer 70 is a valid selection, it generates a valid signal which is applied to the transmit-receive buffer 70. This causes the transmit-receive buffer 70 to apply the 16 bit signal representing the voter's choice to cable 11. The serial-by-bit signal is received in transmit-receive buffer 69, converted to a parallel-by-bit signal and decoded by the scan receive circuit 73. This decodes the 16 bit signal into the address of the particular switch which had been depressed. Scan receive circuit 73 generates a signal which sets a flip-flop associated with that switch. For example, if the voter had depressed the switch 15, the scan receive circuit 73 sets the flip-flop 74. This energizes the light emitting diode 75 which serves as an indicator to the voter that he has selecter the candidate associated with that switch. In the example under consideration, the light emitting diode is mounted directly in the translucent cover of the switch actuator so that the switch actuator is lit to signify a voting choice. If the voter wants to change this selection, he merely depresses the switch 15 again. This repeats the process of transmitting a 16 bit signal to the microcomputer 12 which returns a signal through transmit-receive buffer 69, and scan receive circuit 73. This again applies a signal to flip-flop 74 to reset the flip-flop and deenergize the diode 75. The voter can then make another selection for a candidate for this office.

When the voter has made all of his voting selections, he depresses the record vote switch having contacts 27A to terminate the voting procedure. Switch contacts 27A are continuously scanned by the scan circuit 68 in the same manner as the voting switches are scanned. When the switch contacts 27A are actuated, the scan circuit 68 generates a 16 bit INTERRUPT signal which is applied to the transmit-receive buffer 69. The signal is transmitted serially over the cable to the transmit-receive buffer 70. The operations section 71 of the computer detects a record vote signal. It generates a load memory signal which transfers the voting signals stored in the input section 72 into the main memory 76. These signals are all stored at the proper addresses so that they can later be recalled and totalized at the end of the voting day.

If the voter wants to select candidates from another group of candidates he moves the shield 18 which results in closure of the switch contact 52A and change in position of the switch contacts 53A as previously described. The scanning circuit 68 senses the closure of contacts 52A and generates a 16 bit INTERRUPT signal representing the address of this switch. This signal is transmitted to the computer in the manner previously described where it is stored in the transmit-receive buffer 70. The INTERRUPT signal causes the computer to determine whether scanning circuit 68 detects the closure of switch contacts 53A. For example, if switch contacts 53A are closed, and this is a change from the previous position, then the section of input section 72 into which incoming signals are stored is changed. For example, if incoming signals were previously being stored in input section 72A, this is changed so that incoming signals are now stored in input section 72B. Now, when the voter depresses any of the voting switches, they will generate the same address signals as previously generated, but they will be stored in a different section of input section 72 of the memory. When these signals are transferred to the main memory 76 they will be stored as votes for a different set of candidates.

Now assume that the voter wishes to make a personal choice selection. The thirty eight keys on the personal choice keyboard 25 operate switches of the same type as the voting switches previously described. Before making a personal choice the voter depresses the switch 67 (shown in FIGS. 2, 3 and 10A). This generates a 16 bit signal which, when applied to the computer, reserves a section of memory for succeeding 16 bit signals representing alphabetic characters of a personal choice. The voter then depresses the appropriate keys to spell out the name of his personal choice. These keys operate switch contacts 80A, 81A and others. When one of these switches is operated, 16 bit signals are generated and transmitted to the digital computer in the manner previously described. Upon receipt of each validly received alphabetic signal, the same signal is retransmitted back to the terminal, through transmit-receive buffer 69 and scan-receive circuit 73. Scan-receive circuit 73 decodes the received signal and energizes the appropriate one of the character generators 82, 83 and others. These character generators selectively energize light emitting diodes in the display 26 to generate the alphabetic character which has been typed in. In this manner, as the voter depresses the keys of the keyboard 25, the display 26 displays the name of the candidate he is selecting.

The circuitry shown in FIGS. 10A and 10B can be implemented with standard printed circuit components. By way of example, but without limitation, the following components were used in a working embodiment of the invention:

Scanning circuits 68 & 73—74154 and 74157

Transmit-receive buffers 69 and 70—Unverisal Transmit Receive Circuits, AY-3-1014.

Display device 26—Burroughs Self-Scan.

The operations section 71, input section 72, main memory 76 and printer 13 are part of the small general purpose computer previously mentioned. Any programmable general purpose computer can be used to carry out these functions.

The computer 12 controls printer 13, which is used to print out the list of candidates column by column for each terminal before the polls are open. After the polls are closed, the printer 13 prints out a list of candidates together with the total vote each has received. The printer is operated by INTERRUPT inputs which are supplied to the computer through external switches. The print control switch 80 has four positions. A key can be inserted into the mechanism controlling the switch as its two extreme positions. The first intermediate position applies an INTERRUPT signal to the computer which causes the printer 13 to print a listing of the candidates. The second intermediate position applies an INTERRUPT signal to the computer which causes printer 13 to print out a list of candidates together with the total votes cast for each candidate. A polls-open switch 81 generates an INTERRUPT signal which renders the computer operable to store votes, but disables the printer. The polls-closed switch 82 generates an INTERRUPT Signal which renders the computer inoperative for storing votes, but operable for printing out totals. The switches 80, 81 and 82 are mechanically interlocked for voting security in a manner which will be described next.

The Lock Mechanisms, FIGS. 11–14

In order to prevent voting fraud, the print selector lock 13A, polls-open lock 13B, and polls-closed lock 13C (FIG. 1) are provided. These locks are accessible from the outside of the computer case, but they can only be operated in a prescribed manner because of mechanical interlocking. The door 83 of the computer case is locked by the door lock 14 which is a standard mechanical lock. Only a supervisory election official has the key to the door lock 14. The inside of the case is inaccessible at the polling place.

Figure 12:
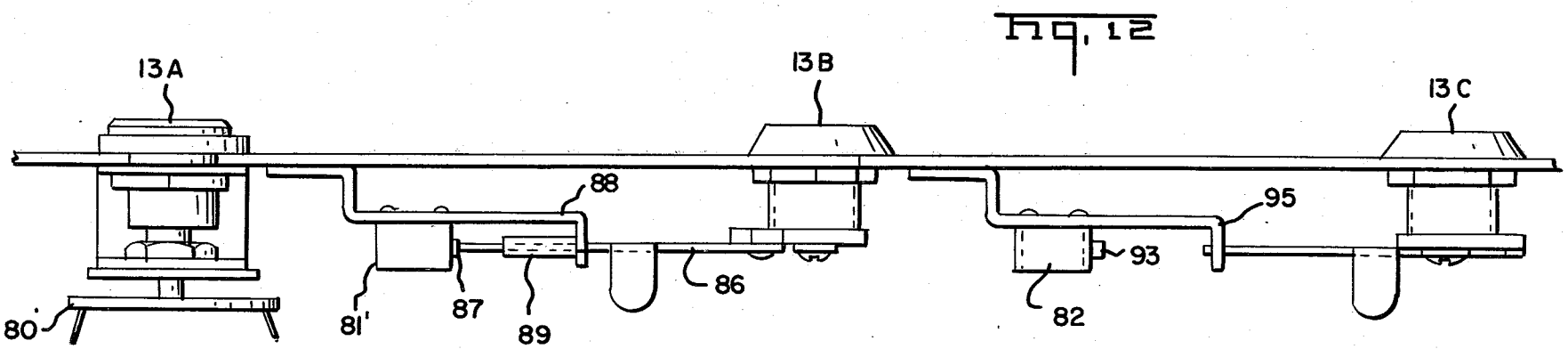
FIG. 12 shows the components of FIG. 11 as viewed from below.
Figure 11:
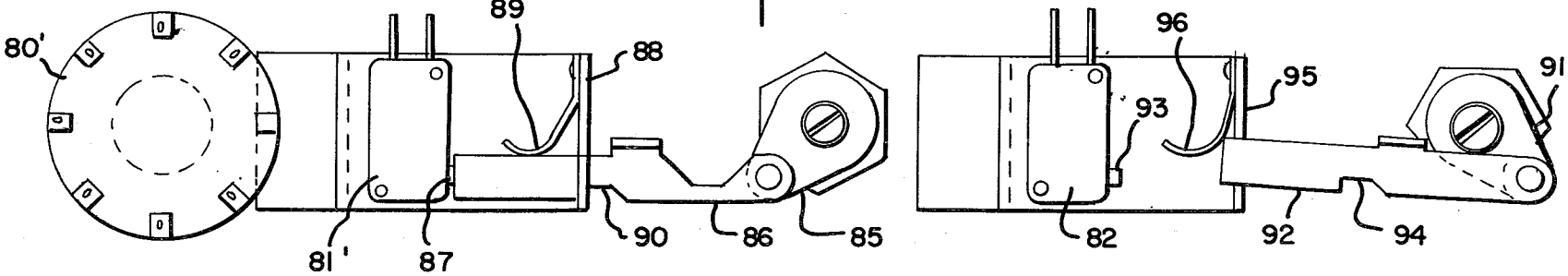
FIG. 11 shows the locking mechanisms on the central processor as viewed from the front thereof.
Figure 17:
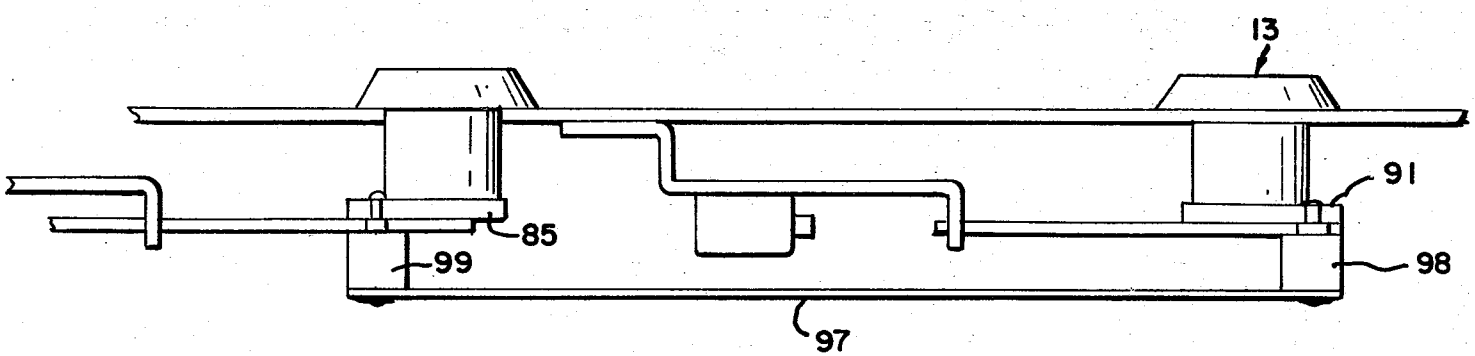
Figure 16:
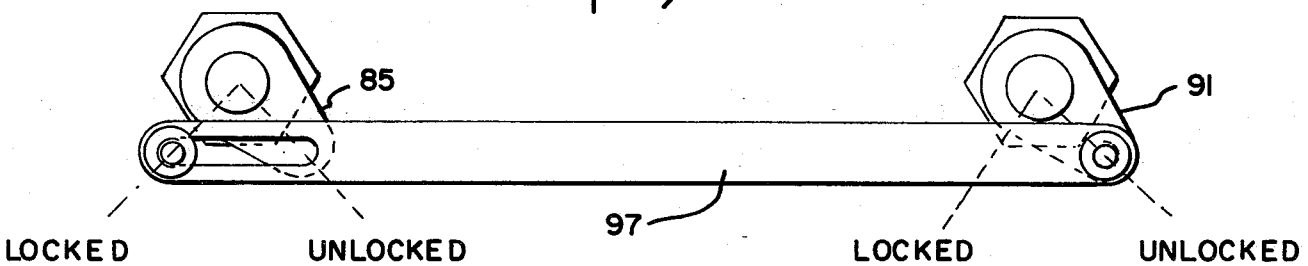

Referring to FIGS. 11 and 12, the print control lock 13A is a four position lock with a key that can be installed and removed at any time. The key merely turns the switch 80 to one of four positions. A key is installed and turned to a "verify" position at the warehouse to cause the printer to list the candidates for a selected office in the order shown for a particular terminal. The key can then be removed and put into the custody of an election official for use at the polling place. Before the polls are opened, the election officials may manipulate the key to cause the printer to list all candidates, issues, offices, etc., on all terminals to show that all ballot strips are installed correctly and that all candidate counters show all zeros. Lock 13B is used to open the polls for voting by inserting a key in lock 13B and turning it one-quarter turn. The toggle 85 is rotated counterclockwise to the position shown in full lines in FIG. 11. This moves the link 86 toward the left to depress the plunger 87 on the switch 81. As previously discussed, this generates an INTERRUPT signal which causes the computer to open the polls. That is, in this position, the computer memory accepts votes cast but the printer 13 cannot be operated. The link 86 is guided through a hole in bracket 88. Spring 89 applies a downward bias to link 86. A notch 90 engages bracket 88. Because of the downward bias of the spring 89, the link 86 cannot be moved back toward the right. That is, once the polls open, the switch 13B has been rotated to the polls-open position, it cannot be rotated back. The key is mechanically locked in the lock and cannot be removed at the polling plate. Since the polls-open lock 13 is locked in the open position, the computer is locked in a mode whereby the printer 13 is inoperative. This prevents access to the voting totals during the time that the polls are open.

At the end of the voting day, a key is inserted in polls-closed lock 13C and it is turned one-quarter turn to close the polls. This rotates the toggle 91 clockwise causing the link 92 to move toward the left where it engages plunger 93 of the switch 82, and this generates an INTERRUPT signal which closes the polls as previously discussed. That is, the computer is now disabled from storing further votes in its memory, but the printer is enabled and can be operated by the switch 80. The link 92 has a notch 94 which engages the bracket 95. A spring 96 applies downward pressure to the link 92 preventing movement of the link toward the right. This prevents the polls from being reopened once they have been closed.

FIGS. 13 and 14 show a further link 97 which prevents the accidental operation of polls-closed lock 13C before polls-open lock 13B is operated. Stand-offs 98 and 99 connect the toggles 91 and 85 with the link 97.

After the system has been returned to the custodian's care, he can use his key to open the door lock 14. This provides access to links 86 and 92. These links are merely raised to disengage the notches on the links from the brackets. Then both links 13B and 13C can be reset in order to set the machine up for another election.

While a particular embodiment has been shown and described it will be understood that various modifications may occur to those skilled in the art without departing from the true spirit and scope of the invention. The appended claims are intended to cover all such modifications.

What is claimed is:

1. A voting system comprising:

an electronic memory for storing votes cast for candidates, a plurality of voting switches connected to said memory for storing said votes therein when said switches are actuated, said voting switches being mounted on a panel of said voting system, said panel having ballot information thereon, a shield having one or more sets of ballot information thereon, with cut-out portions on said shield and exposing said switches, said shield being movable with respect to said panel so that said shield can be moved to one position with one set of ballot information visible adjacent to said voting switches, and moved to another position with another set of ballot information visible adjacent to said switches, and switch means operated coincidentally with movement of said shield, said switch means connecting said voting switches to one portion of said memory when said shield is in said one position and to a different portion of said memory when it is in said other position whereby the same voting switches can be used to vote for two different groups of candidates.

2. The voting system recited in claim 1 wherein said switch means comprises first and second switches, said first switch being momentarily operated upon movement of said shield to generate an INTERRUPT signal which is connected to said electronic memory, said second switch being operated to a first condition when said shield is in said one position and to a second condition when said shield is in said other position, said second switch being connected to control the portion of said memory in which said votes are stored.

* * * * *

UNITED STATES PATENT AND TRADEMARK OFFICE

CERTIFICATE OF CORRECTION

PATENT NO. : 4,178,501

DATED : December 11, 1979

INVENTOR(S) : Henry D. Luther

It is certified that error appears in the above-identified patent and that said Letters Patent are hereby corrected as shown below:

Col. 5, line 53, after "stored in", delete "tramsit-receive" and insert therefor --transmit-receive--.

Col. 6, line 23, after "has" delete "selecter", and insert therefor --selected--.

Col. 6, line 31, delete "microcomputer" and insert therefor --minicomputer--.

Signed and Sealed this

*Seventeenth* Day of *June 1980*

[SEAL]

*Attest:*

SIDNEY A. DIAMOND

*Attesting Officer*

*Commissioner of Patents and Trademarks*